United States Patent [19]

Holzhauser

[11] Patent Number: 4,474,111

[45] Date of Patent: Oct. 2, 1984

[54] CLEANING SYSTEM FOR PRINTING PRESSES

[75] Inventor: Max Holzhauser, Rodgau, Fed. Rep. of Germany

[73] Assignee: M.A.N. - Roland Druckmaschinen Aktiengesellschaft, Fed. Rep. of Germany

[21] Appl. No.: 397,171

[22] Filed: Jul. 12, 1982

[30] Foreign Application Priority Data

Jul. 22, 1981 [DE] Fed. Rep. of Germany ..... 3128928

[51] Int. Cl.[3] ..... B41F 35/00; B41L 41/00

[52] U.S. Cl. ..... 101/425; 137/132

[58] Field of Search ..... 101/425; 137/124, 126, 137/128, 132, 133, 134, 136, 142, 145

[56] References Cited

U.S. PATENT DOCUMENTS 3,321,140 5/1967 Parkison et al. ..... 239/428.5
3,913,797 10/1975 Brym ..... 101/425 X

FOREIGN PATENT DOCUMENTS 568231 3/1924 France ..... 137/132
325281 3/1935 Italy ..... 137/132

*Primary Examiner*—Paul T. Sewell
*Assistant Examiner*—David A. Wiecking
*Attorney, Agent, or Firm*—Leydig, Voit, Osann, Mayer & Holt, Ltd.

[57] ABSTRACT

A cleaning system for a printing press having a chamber for the cleaning liquid, a supply line with a valve for controlling the flow of liquid into the chamber and a nozzle connected to the chamber at a point above the bottom of the chamber and extending above the area to be cleaned. A siphon of inverted U-shape having an inlet extending to near the bottom of the chamber is positioned so that the outlet is below the inlet and above the area to be cleaned. The siphon is sufficiently shallow so that the siphon is completely filled when the cleaning liquid is being discharged through the nozzle, with the result that when the valve is closed the siphon serves both to lower promptly the level of liquid in the chamber and to cause a reverse flow of air through the nozzle, to inhibit dripping therefrom.

3 Claims, 5 Drawing Figures

FIG. 1
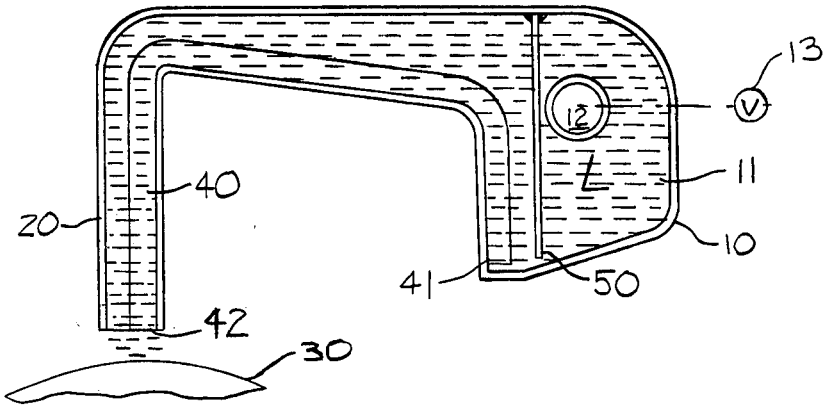
FIG. 2
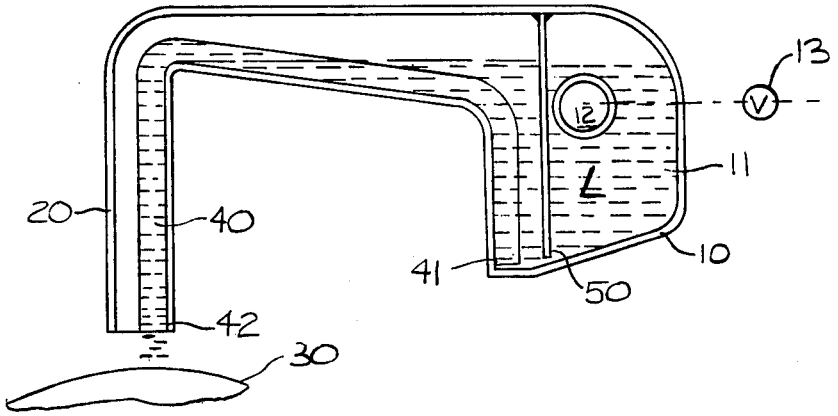
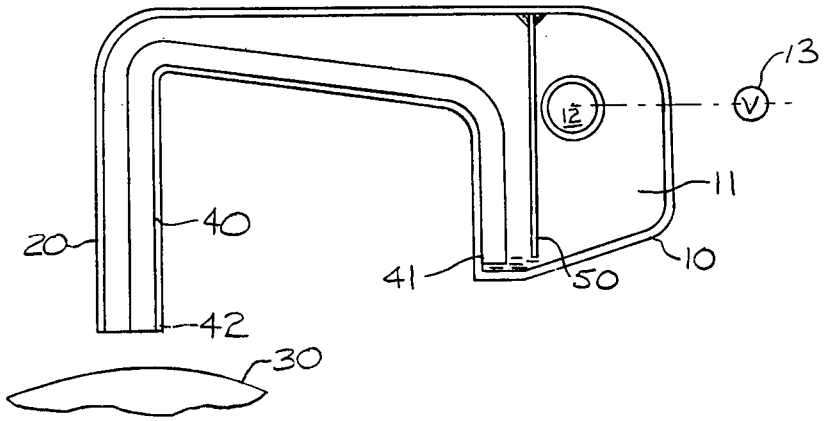
FIG. 3

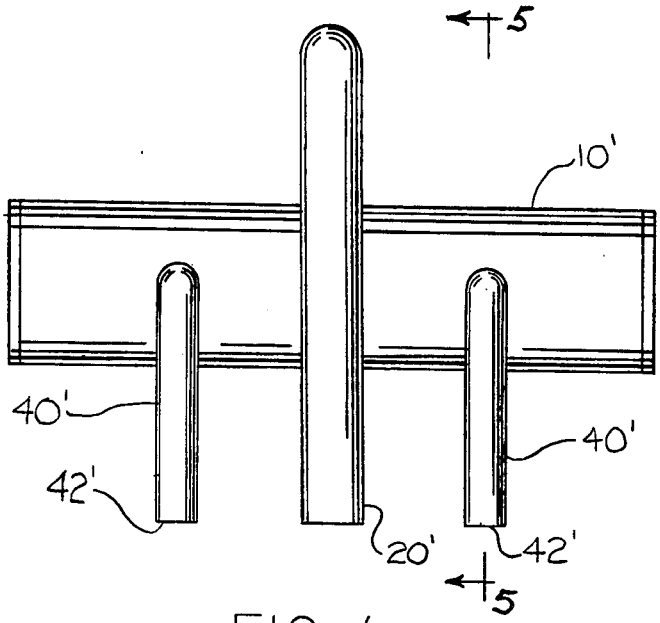
FIG. 4
FIG. 5
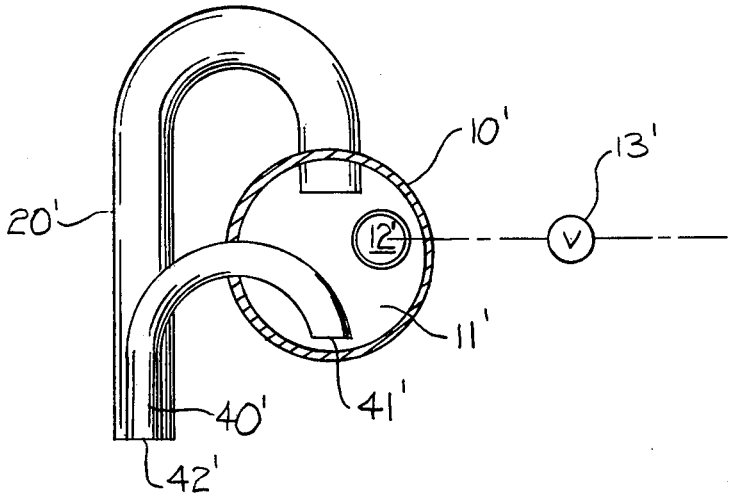

CLEANING SYSTEM FOR PRINTING PRESSES

The ink rollers of a printing press must be cleaned periodically, particularly if the printing press will not be operating, since unless the ink is removed from the rollers, the ink may dry and impair a subsequent printing run. Conventionally, ink rollers are cleaned by spraying a cleaning liquid on the roller surface as disclosed in Switall U.S. Pat. No. 3,508,711, which issued Apr. 28, 1970. The cleaning liquid is then generally removed from the rollers by a doctor blade placed at a suitable point.

The Switall patent describes a cleaning system in which a cleaning liquid is sprayed on the surface of the ink rollers through nozzles. To prevent the nozzles from dripping and thereby dispersing the film of ink on the roller surface, pressure sensitive valves seal the nozzle outlets when the spraying is completed. It has been found, however, that this arrangement does not reliably prevent dripping because a residuum of cleaning liquid may collect at the edge of the nozzle and ultimately reach the roller surface.

A further arrangement designed to prevent dripping is described in German Pat. No. 2,504,572. There the residual cleaning liquid, which collects at the edge of the nozzle, is removed by suction. The negative pressure required for this purpose is generated by a piston pump, which also serves to convey the cleaning liquid through the nozzle. This design, however, requires elaborate machinery having close tolerances and is consequently too expensive to be incorporated into a standard printing press.

Accordingly, it is an object of the present invention to provide a cleaning system for a printing press which is reliably drip proof, which is simple and inexpensive to manufacture and install, and which is maintenance free. It is a related object of the invention to provide a device which is inherently durable and long lived.

It is another object of the invention to provide a cleaning system which discharges quietly and free of turbulence even though under the control of an inlet valve which is abruptly turned on and off.

It is yet another object of the invention to provide a drip proof cleaning system which is compact and self-emptying and which, therefore, may be adapted to a variety of printing presses normally available in the marketplace without necessity for extensive modification or adjusting to size.

Other objects and advantages of the invention will become apparent upon reading the attached detailed description and upon reference to the drawings in which:

FIG. 1 is a cross sectional end elevation of a cleaning system constructed in accordance with the invention and which shows the device during the normal application of the cleaning liquid to the roller surface;

FIG. 2 shows the device upon shut-off of the inlet valve;

FIG. 3 shows the device at the end of the siphoning cycle;

FIG. 4 shows an alternate cleaning system constructed in accordance with the present invention; and, FIG. 5 is a cross sectional view taken along line 5—5 in FIG. 4.

While the invention has been described in connection with a preferred embodiment, it will be understood that I do not intend to be limited to the particular embodiments shown but intend, on the contrary, to cover the various alternative and equivalent constructions which may be included within the spirit and scope of the appended claims.

Turning now to the drawings, there is disclosed in FIG. 1 a cleaning system for a printing press having a housing 10 defining a chamber 11 for a cleaning liquid L fed by a supply line 12 including a valve 13 for controlling the flow of cleaning liquid into the chamber. An outlet nozzle 20, connected to the chamber 11 at a point well above the bottom of the chamber, extends above the area 30 to be cleaned. In this way, when the valve is open, the cleaning liquid is discharged through the nozzle so as to reach the surface to be cleaned.

In accordance with the present invention a siphon of inverted U-shape is provided extending from the bottom of the chamber to a point above the region to be cleaned, both to lower promptly the level of the cleaning liquid in the chamber and to cause a flow of air through the nozzle to inhibit dripping therefrom.

Thus, as shown in the drawings, the siphon 40 has an inlet 41, which extends to near the bottom of the chamber 11, and an outlet 42, which is above the area 30 to be cleaned and which is below the inlet 41. In order to prime the siphon, the siphon must be sufficiently shallow so as to be completely filled when the valve 13 is open and cleaning liquid is being discharged through the nozzle 20, as shown in FIG. 1. When the valve 13 is closed, flow through the nozzle 20 is cut off as shown in FIG. 2. However, as also shown in the figure, the siphon is then full and continues to flow and promptly lower the level of liquid in the chamber, and causes a flow of air through the nozzle in a direction opposite to the normal flow of cleaning liquid therethrough. In this way dripping from the nozzle is inhibited. Siphoning continues until the chamber 11 is substantially empty.

In carrying out the invention, the chamber 11 is divided by a partition 50, which extends to near the bottom of the chamber and which is interposed between the supply line 12 and the outlet nozzle 20. So positioned, the partition allows the cleaning liquid to reach the nozzle substantially without turbulence thus ensuring a quiet and uniform discharge of cleaning liquid through the nozzle. While this aspect of the invention has been described in connection with the solid partition shown in FIGS. 1, 2 and 3, one skilled in the art will appreciate that a porous partition may be employed to reduce the turbulence within the chamber without departing from the spirit of the invention.

It is yet another subsidiary feature of the present invention that the siphon may pass through the nozzle, as shown in FIG. 1, so that the cleaning liquid is discharged at the same point above the roller surface through all stages of operation.

In a typical operating sequence, the valve 13 is opened to allow the cleaning liquid to enter the chamber 11. As the cleaning liquid rises in the chamber and flows through the outlet nozzle 20, the cleaning liquid also fills the siphon 40. Thus the cleaning liquid is discharged above the roller surface 30, as shown in FIG. 1. If the valve 12 were now closed and the siphon 40 not present, the chamber 10 would empty only to the level shown in FIG. 2. This arrangement, however, would not reliably prevent dripping from the nozzle since the cut-off point would be reached gradually. Moreover, machine vibrations would tend to cause the cleaning liquid to slosh in waves through the nozzle to make the point of cut-off indeterminate. In the present instance, however, the siphon serves promptly to lower the level of liquid in the chamber to achieve prompt and well-defined cut-off. In addition, the siphon serves to cause a reverse flow of air through the nozzle and into the chamber. This flow of air tends to restrain any residual cleaning liquid which may collect at the edge of the nozzle. Dripping is thus reliably prevented. FIG. 3 shows the cleaning system after the siphon 40 has emptied the chamber 10. The cleaning system is now ready to begin another cycle.

While the inner end 41 of the siphon preferably extends to a point near the bottom of the chamber 11 for substantially complete emptying of the chamber, the end 41 may, if desired, terminate at a higher level without departing from the invention; accordingly the term "near" shall be given a broad interpretation.

As will be noted in FIGS. 4 and 5, which show an alternate form of the invention, similar parts are represented by the same reference numerals with the addition of a prime. An outlet nozzle 20' of inverted U-shape is connected to the chamber 11' at a point near the top of the chamber, a siphon 40' is preferably provided at either side of the nozzle 20'.

In the preferred forms of the invention discussed above, the outlet nozzle 20,20' and the siphon 40,40' have generally circular cross-sections. It is not essential to the invention, however, that the siphon or outlet nozzle be of circular cross-section. One skilled in the art will appreciate that siphons and nozzles having other cross-sections would adequately achieve the desired drip proof feature of the present invention.

I claim as my invention:

1. In a cleaning system for a printing press having an ink roller, the combination comprising means defining a chamber for a cleaning liquid, a supply line including a valve for controlling the flow of liquid into the chamber, outlet means connected to said chamber for directing cleaning liquid onto said roller, said outlet means including a first discharge tube and a syphon discharge tube, said first discharge tube being connected to said chamber at a location above the bottom of the chamber and extending above the area to be cleaned for directing liquid onto the roller when said valve is open, said syphon discharge tube having an inverted U-shape with an inlet adjacent the bottom of the chamber and an outlet above the area to be cleaned, said syphon discharge tube being sufficiently shallow in height so that the syphon discharge tube fills completely and discharges liquid onto said roller when said valve is open and liquid is being discharged onto said roller by said first discharge tube, with the result that when the valve is closed to terminate the flow of liquid from said first discharge tube the siphon serves (a) to lower promptly the level of liquid in the chamber to a level below the location said first discharge tube is connected to said chamber and (b) to cause a flow of air through the first discharge tube in a direction opposite to the normal flow of liquid therethrough to inhibit dripping from the first discharge tube.

2. The combination as claimed in claim 1 wherein the chamber includes a partition which allows the cleaning liquid to reach the outlet means substantially without turbulance.

3. The combination as claimed in claim 1 or in claim 2 in which the siphon discharge tube passes through the first discharge tube.

* * * * *